US005131375A

United States Patent [19]

Sakamoto

[11] Patent Number: 5,131,375

[45] Date of Patent: Jul. 21, 1992

[54] FUEL INJECTION TYPE ENGINE

[75] Inventor: Osamu Sakamoto, Hamamatsu, Japan

[73] Assignee: Sanshin Kogyo Kabushiki, Hamamatsu, Japan

[21] Appl. No.: 639,357

[22] Filed: Jan. 9, 1991

[30] Foreign Application Priority Data

Jan. 10, 1990 [JP] Japan ..... 2-2985

[51] Int. Cl.[5] ..... F02M 67/02; F02M 55/00

[52] U.S. Cl. ..... 123/533; 239/408; 239/585.3

[58] Field of Search ..... 123/531, 533; 239/408, 239/585, 533.2

[56] References Cited

U.S. PATENT DOCUMENTS

| | | | |
|---|---|---|---|
| 4,508,091 | 4/1985 | Wakeman | 123/472 |
| 4,703,740 | 11/1987 | Trapy | 123/531 |
| 4,794,902 | 1/1989 | McKay | 123/531 X |
| 4,938,417 | 7/1990 | Halvorsen | 123/531 X |
| 4,987,878 | 1/1991 | Johnson | 123/531 |

OTHER PUBLICATIONS

Internal Combustion Engine (Japan) vol. 10, No. 116, 1971.11.

*Primary Examiner*—Tony M. Argenbright
*Attorney, Agent, or Firm*—Ernest A. Buetler

[57] ABSTRACT

Two embodiments of air/fuel injectors wherein the fuel is injected to a chamber through a venturi section that receives pressurized air so that the fuel is injected to an area of lower pressure than the air pressure. The chamber is communicated with the engine through an injector valve which opens and closes. The isolation of the point of fuel delivery from the injector valve reduces the likelihood of fuel variations due to variations of the lift of the injector valve. In one embodiment, the venturi section is formed co-axially with the chamber and in another embodiment it is formed externally of the chamber.

14 Claims, 3 Drawing Sheets

FUEL INJECTION TYPE ENGINE

BACKGROUND OF THE INVENTION

This invention relates to a fuel injection type engine and more particularly to an improved air/fuel injector for an internal combustion engine.

One type of fuel injector which is advantageous in connection with two cycle internal combustion engine is an injector of the air/fuel type. With this type of injector, in addition to fuel, pressurized air is injected into the combustion chamber of the engine when the injector valve is opened. Although this type of device has particular advantages, there are some disadvantages with the previously proposed injectors of this type. For example, one type of injector has the fuel delivered to the injector in the area where the injector valve opens and closes. The air flow across the injector outlet when the injector valve is opened creates a vacuum which assist in the delivery of fuel. However, the amount of vacuum produced will vary in relation to the lift of the valve and also during the opening and closing of the valve when the opening area varies. As a result, the fuel delivery to the engine can become unstable and erratic. In addition, it is often desirable to change the amount of lift of the valve during engine running to accommodate changes in engine performance. Of course, the variable lift will give further rise to differences in the amount of fuel injected.

These problems can be avoided to some extent if the fuel is injected in an area other than the area of the injection valve and its seat. However, when this is done the fuel must be injected into a high pressure area and hence the fuel pressure must be greater than the air pressure. This gives rise to the cost of higher pressure fuel injectors and also increases the likelihood of leakage in the system due to the higher pressure of fuel.

It is, therefore, a principal object of this invention to provide an improved air/fuel injector for an internal combustion engine.

It is a further object to this invention to provide an air/fuel injector wherein the fuel can be injected into a low pressure area and wherein the amount of fuel delivered will be independent of the operation of the injection valve.

It is a further object to this invention to provide an improved fuel/air injector of the type having an injection valve and wherein the fuel is delivered to a low pressure area upstream of the injection valve to avoid variations in the amount of fuel delivery and response to the position of the injection valve.

It is a further object to this invention to provide an improved air/fuel injector of a type wherein the fuel can be injected into a low pressure area even though high pressure air is employed to assist in the fuel delivery.

SUMMARY OF THE INVENTION

This invention is adapted to be embodied in an air/fuel injector having an injection valve controlling the communication of a chamber with the combustion chamber of an associated internal combustion engine. A fuel injector is provided for injecting fuel into the chamber for delivery when the injection valve is opened. In accordance with a feature of the invention, the fuel is injected from the fuel injector into the chamber through a low pressure area wherein the pressure is less than the air pressure within the chamber.

DETAILED DESCRIPTION OF THE PREFERRED EMBODIMENTS OF THE INVENTION

Figure 1:
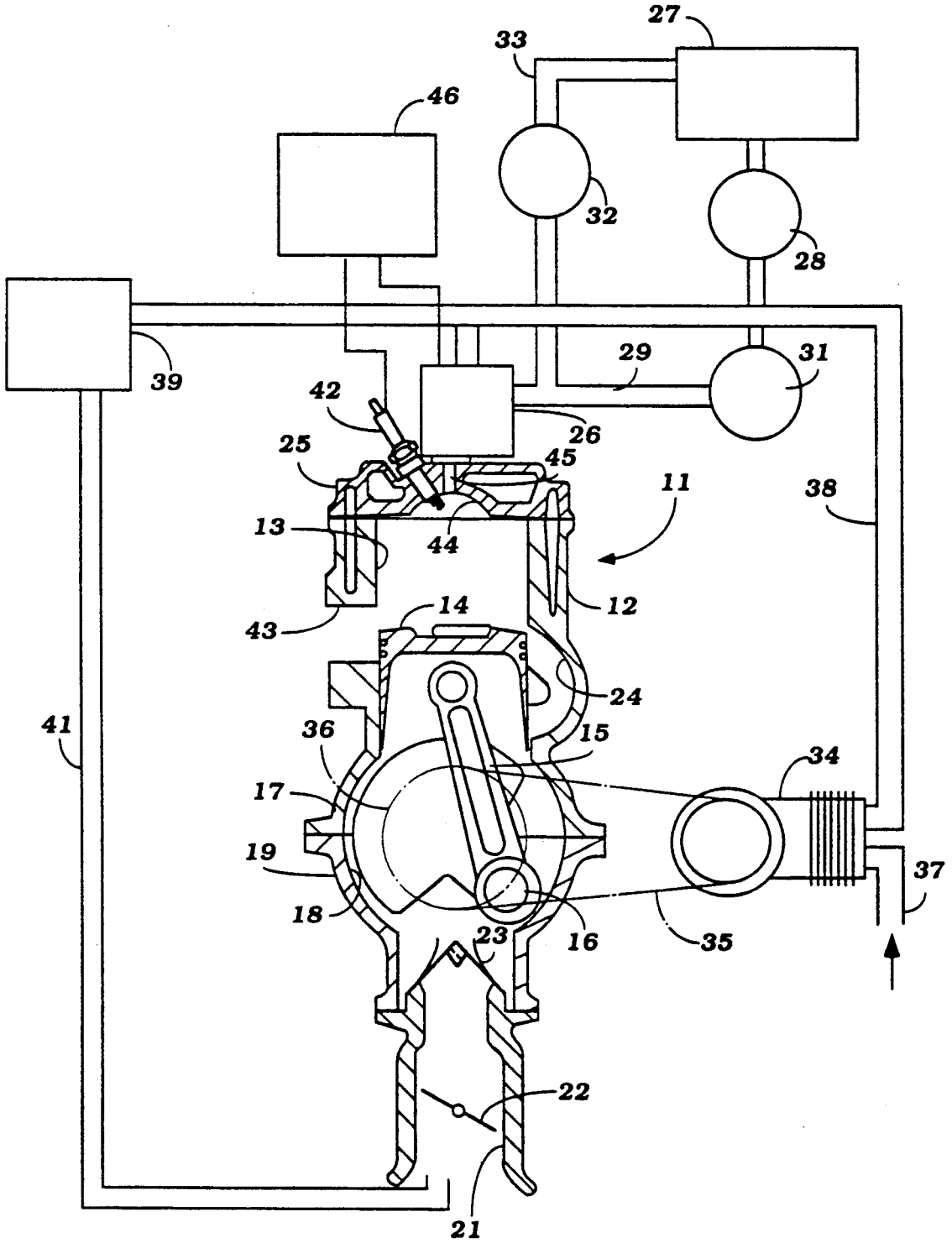
FIG. 1 is a partially schematic cross sectional view taken along through a single cylinder of a two-cycle crankcase compression internal combustion engine having a fuel/air injection system constructed in accordance with embodiments of the invention, with certain of the auxiliary components being shown schematically.

Referring first to FIG. 1, a single cylinder of a three cylinder two-cycle crankcase compression internal combustion engine having a fuel/air injection unit constructed in accordance with an embodiment of the invention is identified generally by the reference numeral 11. Only a single cylinder of the engine 11 is depicted because it is believed that those skilled in the art can readily understand how the invention can be employed in connection with multiple cylinder engines. Also, although the invention is described in conjunction with a reciprocating engine, the invention can be equally as well practiced with other types of engines and also engines that operate on other than the crankcase compression principal. However, the invention does have particular utility in conjunction with two-cycle engines.

The engine 11 includes a cylinder block 12 formed with a cylinder bore 13 in which a piston 14 reciprocates. The piston 14 is connected by means of a connecting rod 15 to a throw 16 of a crankshaft, indicated at 17, for driving the crankshaft in a known manner.

The crankshaft 17 is rotatably journaled within a crankcase chamber 18 that is formed by the cylinder block 12 and a crankcase 19 that is affixed to the cylinder block in any suitable manner. An air charge is delivered to the crankcase chamber 18 through an intake manifold 21 in which a flow controlling throttle valve 22 is positioned. A reed type check valve 23 is interposed between the intake manifold 21 and the crankcase chamber 18 so as to preclude reverse flow, as is well known in this art. The charge which has been admitted to the crankcase chamber 18 will be compressed during downward movement of the piston 14 and then is transferred to the combustion chamber through one or more scavenge ports 24.

A cylinder head 25 is affixed to the cylinder block 12 and supports a fuel/air injection unit, indicated generally by the reference numeral 26. The construction of the fuel/air injection unit 26 will be described later.

Fuel is supplied to the fuel/air injection unit 26 from a remotely positioned fuel tank 27 by means of a fuel pump 28 and conduit 29. A fuel filter 31 is provided in this conduit 29 and filters the fuel delivered to the fuel/air injection unit 26. A pressure relief valve 32 is positioned in a return conduit 33 that leads back to the fuel tank 27 and which maintains a uniform head of fuel in the fuel/air injector unit 26 by bypassing excess fuel back to the tank 27.

Compressed air is delivered to the fuel/air injection unit 26 from an air compressor 34. The air compressor 34 is driven by means of a belt 35 from a pulley 36 that is affixed to the crankshaft 17 for rotation with it. The compressor 34 draws air from the atmosphere through an inlet 37 and delivers it to the fuel/air injection unit 26 by means of a supply conduit 38. The air pressure is regulated by a pressure regulator and accumulator 39 which regulates the air pressure by returning excess air to the induction manifold 21 through a bypass conduit 41.

A spark plug 42 is provided in the cylinder head 26 for firing the fuel/air charge generated both by the injector unit 26 and the induction system already described. The burnt fuel/air charge is then discharged to the atmosphere through an exhaust port 43.

The fuel/air injector 26 injects fuel into a combustion chamber 44 formed in part by a recess in the cylinder head 25 through a delivery passage 45. The fuel/air injector 26 and spark plug 42 are controlled by a control unit, indicated generally by the reference numeral 46. The control unit 46 may operate on any desired strategy. However, basically the strategy is such that the injection valve is opened and fuel of the fuel/air injector 26 is then delivered.

Figure 2:
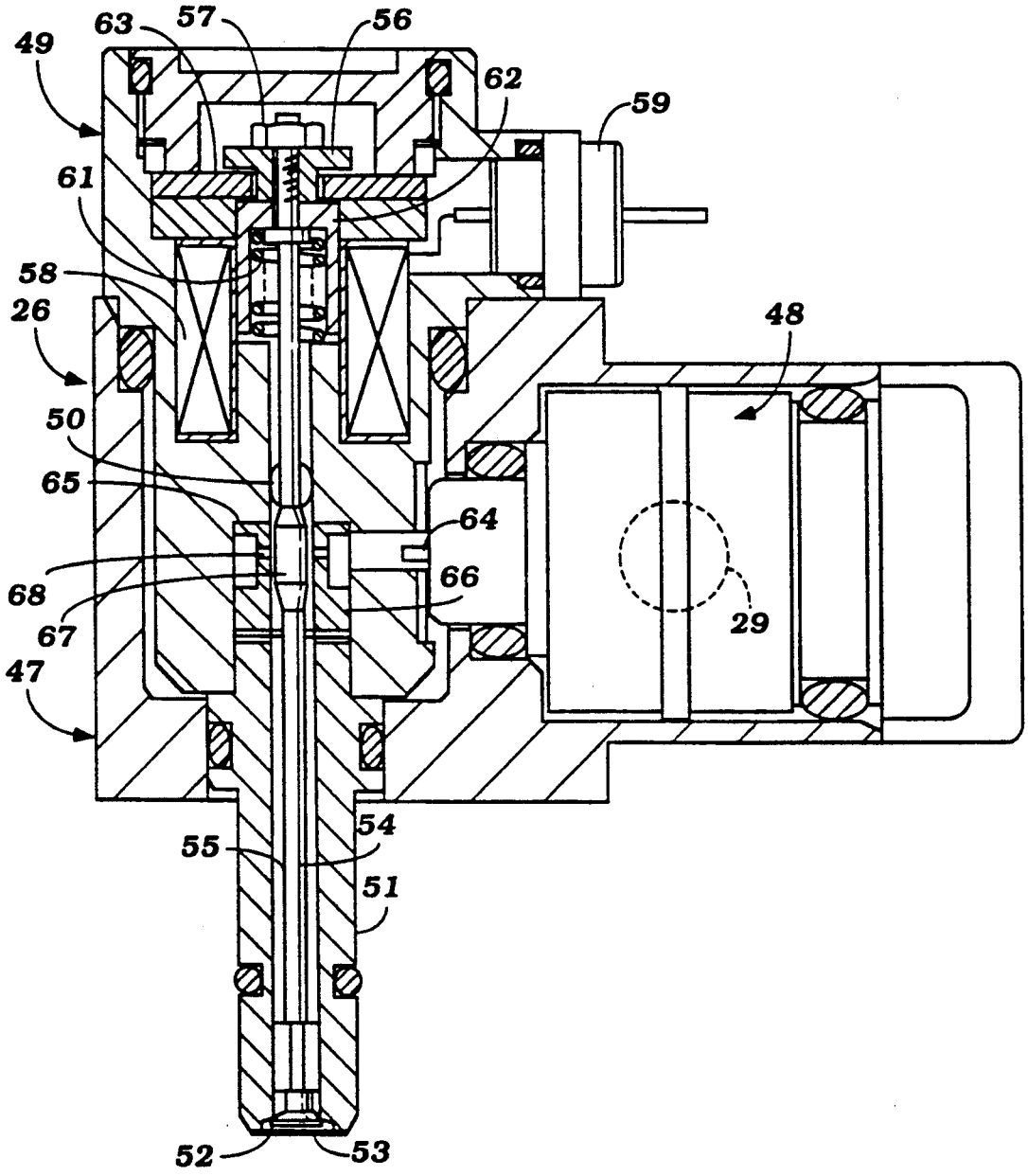
FIG. 2 is an enlarged cross sectional view taken through the air/fuel injector.

The construction of one type of fuel/air injector is shown in FIG. 2 and will now be described by reference to that figure. The fuel/air injector 26 is comprised of an outer housing assembly, indicated generally be the reference numeral 47 and which mounts a fuel injector, 48 which is supplied with fuel from the system described previously including the inlet conduit 29 and an air injector portion, indicated generally by the reference numeral 49 and which supplies air from an air port 50 that is communicated with the conduit 38.

The housing assembly 47 has a pilot portion 51 which extends into the delivery passage 45 of the cylinder head and which defines a valve seat 52 that is opened and closed by a head portion 53 of an injection valve, indicated generally by the reference numeral 54. The injection valve 54 extends through the pilot portion 51 with a clearance therebetween which defines a chamber 55 to which air is delivered under pressure from the port 50.

The injection valve 54 has affixed to its upper end an armature plate 56 by means of a nut 57 so as to provide an axial adjustment for the armature plate 56 on the injection valve 54 to control the maximum lift of the valve head 53.

A solenoid winding 58 encircles the stem of the valve 54 and is energized through a conductor 59 from the controller 46.

A coil compression spring 61 acts against a cup-shape member 62 that is held axially to the stem of the injection valve 54 against the armature plate 56. The opposite end of the spring 61 reacts against the housing 47 so a to hold the injection valve 54 in its closed position until the solenoid 58 is energized. When the solenoid 58 is energized, the armature plate 56 will move downwardly until it contacts a stop plate 63 which sets the maximum opening area for the injector valve 54 and air under pressure can then be discharged.

In accordance with an important feature of the invention, the fuel injector 48 is mounted so that its nozzle portion 64 extends perpendicularly to the chamber 56. However, the nozzle . portion 64 communicates with a restricted annular recess 65 formed between a sleeve 66 mounted within the housing assembly 47 and an enlarged cylindrical portion 67 formed on the stem of the injector valve 54. The injector nozzle 64 communicates with the annular recess 65 through one or more radially extending ports 68 formed in the sleeve 66.

In accordance with the invention, the cross sectional area of the passageway 65, regardless of the axial position of the injection valve 54 is less than the maximum cross sectional flow area provided by the valve head 53 and the seat 52 when the valve head 53 is it fully opened position. As a result of this difference in cross sectional area, the amount of fuel discharged will always be into a substantially constant vacuum and will not be dependent upon the degree of valve lift. As a result, more uniform fuel delivery will be possible. In addition, since the injector 48 injects into an area that is a lower pressure than the pressure of air in the chamber 55 a lower pressure fuel injector can be employed so as to avoid leakage and cost problems.

Figure 3:
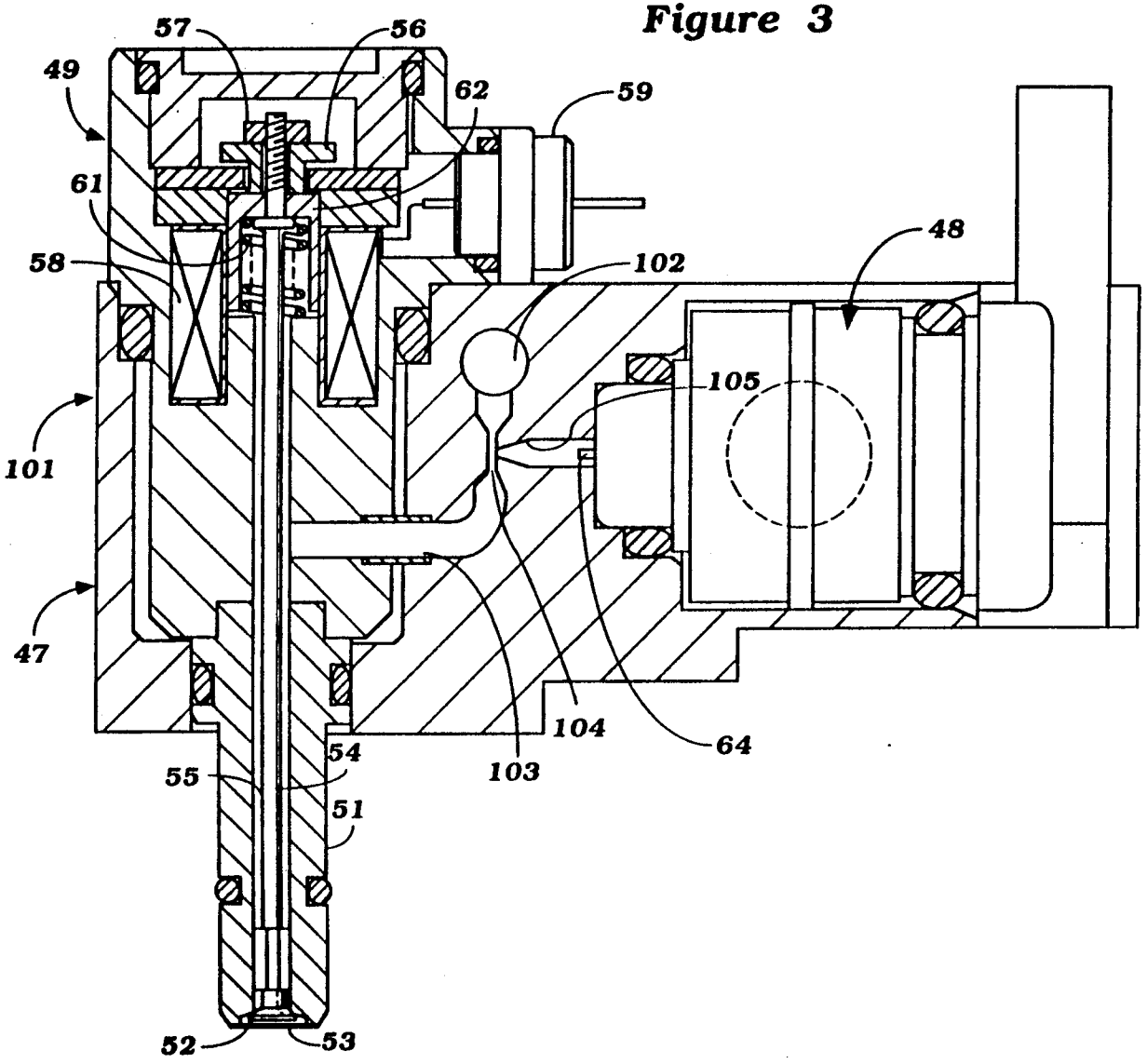
FIG. 3 is a cross sectional view, in part similar to FIG. 2, and shows another embodiment of the invention.

In the embodiment previously described a venturi like effect was provided by an enlarged diameter portion of the injection valve and the surrounding portion of the housing assembly. FIG. 3 shown another embodiment of the invention which is generally the same as the embodiment of FIG. 2. In this embodiment, however, the venturi section is formed solely by the housing assembly. Aside from this difference, the construction and operation of this embodiment is the same as the previously described embodiment and, for that reason, components which are the same or substantially the same have been identified by the same reference numerals and will be described again only insofar as is necessary to understand the construction and operation of this embodiment.

In this embodiment, the fuel/air injector is identified generally by the reference numeral 101 and an air port 102 which communicates with the conduit 38 for supplying air pressure is formed in the housing at an appropriate location adjacent the fuel injector 48. The port 102 communicates with a supply passage 103 which extends through the housing assembly 47 and which intersects the chamber 55 in a generally perpendicularly extending direction. A venturi section 104 is provided in the passage 103 between the port 102 and the communication with the chamber 55. The fuel injector nozzle 64 is disposed so as to be directed through a channel 105 which communicates with the venturi section 104 and hence the fuel delivery will be to a low pressure area and fuel delivery will not be dependent upon the degree of lift of the valve head 53. In this embodiment, the cross sectional area of the venturi throat 104 is less than the effective cross sectional flow area of the injector valve 54 when the valve head 53 is at its highest lift from the seat 52.

From the foregoing descriptions, it should be readily apparent that the described embodiments of the invention are very effective in providing an air/fuel injector wherein the fuel is injected by the fuel injector into a area that is at a lower pressure than the air pressure and thus permits the use of low pressure fuel injection. In addition, because of the fact that the low pressure area is disposed upstream of the injection valve and separated therefrom by a cavity, pressure variations due to the degree and amount of lift of the injection valve will not affect the amount of fuel injected. Of course, the foregoing description is that of preferred embodiments of the invention and various changes and modifications may be made without departing from the spirit and scope of the invention, as defined by the appended claims.

I claim:

1. A fuel/air injector for injecting fuel into the combustion chamber of an internal combustion engine comprising an injection valve, a chamber adapted to communicate with the engine combustion chamber when said injection valve is opened, and means including a fuel injector for delivery of fuel under pressure to said chamber at an area of lower air pressure than the air pressure in said chamber, said fuel injector injecting directly to said low pressure area.

2. A fuel/air injector as set forth in claim 1 wherein the low pressure area is provided by a venturi section that connects an air pressure source with the chamber.

3. A fuel/air injector as set forth in claim 2 wherein the venturi section is co-axially disposed with the chamber.

4. A fuel/air injector as set forth in claim 2 wherein the fuel injector injects fuel adjacent the venturi section.

5. A fuel/air injector as set forth in claim 4 wherein the fuel is injected in a perpendicular direction to the venturi section and into the chamber.

6. A fuel/air injector for injecting fuel into the combustion chamber of an internal combustion engine comprising an injection valve, a chamber adapted to communicate with the engine combustion chamber when said injection valve is opened, and means for delivery of fuel under pressure to said chamber at an area of lower air pressure than the air pressure in said chamber provided by a venturi section that connects an air pressure source with said chamber, said venturi section being co-axially disposed with said chamber and formed by an enlargement on a stem of said injection valve that passes through said chamber.

7. A fuel/air injector as set forth in claim 6 wherein the fuel is injected in a perpendicular direction to the venturi section and into the chamber.

8. A fuel/air injector for injecting fuel into the combustion chamber of an internal combustion engine comprising an injection valve, a chamber adapted to communicate with the engine combustion chamber when said injection valve is opened, and means for delivery of fuel under pressure to said chamber at an area of lower air pressure than the air pressure in said chamber provided by a venturi section that connects an air pressure source with said chamber, said venturi section being formed externally of said chamber and communicating with said chamber through an air/fuel passage.

9. A fuel/air injector for injecting fuel into the combustion chamber of an internal combustion engine comprising an injection valve, a chamber adapted to communicate with the engine combustion chamber when said injection valve is opened, and means for delivery of fuel under pressure to said chamber at an area of lower air pressure than the air pressure in said chamber defined by an area having an effective cross sectional flow area that is less that the effective cross sectional are of said injection valve when said injection valve is at maximum lift.

10. A fuel/air injector as set forth in claim 9 wherein the low pressure area is provided by a venturi section that connects an air pressure source with the chamber.

11. A fuel/air injector as set forth in claim 10 wherein the venturi section is co-axially disposed with the chamber.

12. A fuel/air injector as set forth in claim 11 wherein the venturi section is formed by an enlargement on a stem of the injection valve that passing through the chamber.

13. A fuel/air injector as set forth in claim 12 wherein the fuel is injected in a perpendicular direction to the venturi section and into the chamber.

14. A fuel/air injector as set forth in claim 10 wherein the venturi section is formed externally of the chamber and communicates with the chamber through an air/fuel passage.

* * * * *